United States Patent [19]

Ickes

[11] Patent Number: 4,526,160

[45] Date of Patent: Jul. 2, 1985

[54] APPARATUS FOR CONTROLLING FLOW OF COMBUSTION PRODUCTS

[76] Inventor: John C. Ickes, 2017 S. Florida, Joplin, Mo. 64801

[21] Appl. No.: 155,610

[22] Filed: Jun. 2, 1980

[51] Int. Cl.[3] ..... F23L 3/00

[52] U.S. Cl. ..... 126/292; 126/285 R; 126/307 R; 110/163

[58] Field of Search ..... 126/285 R, 289, 290, 126/312, 307 R, 307 A, 292, 293, 294; 110/147, 163, 148; 236/45

[56] References Cited

U.S. PATENT DOCUMENTS 1,493,488 5/1924 Holland ..... 110/163
1,540,611 6/1925 Disco ..... 126/292

FOREIGN PATENT DOCUMENTS 53804 1/1890 Fed. Rep. of Germany ... 126/285 R

*Primary Examiner*—James C. Yeung
*Attorney, Agent, or Firm*—Robert S. Smith

[57] ABSTRACT

Apparatus for cooperation with an associated flue having a first axis extending away from a point proximate to an associated combustion chamber which includes a funnel shaped member having first and second ends. The second end is larger than the first end. A damper is disposed in the associated flue which has a generally central bore. The damper is mounted in the associated flue for rotation about a second axis which is generally perpendicular to the first axis and the funnel shaped member is mounted with the first end higher than the second end and with the second end extending into the damper. The mounting for the damper may comprise at least one rod shaped member extending through at least one wall of the associated flue. The mounting for the funnel shaped member may comprise a plurality of elongated members extending radially from the funnel shaped member to the associated flue. In another form of the invention a first duct is disposed within a second duct which is in fluid communication with an associated flue. The first duct may be rectangular in cross section and generally planar members may be selectively pivoted to restrict flow intermediate the first and second ducts. The first duct will ordinarily have no restriction on the flow of exhaust gases other than the restriction inherent in the inner duct.

10 Claims, 7 Drawing Figures

APPARATUS FOR CONTROLLING FLOW OF COMBUSTION PRODUCTS

BACKGROUND OF THE INVENTION

The invention relates to apparatus for burning wood and the like and particularly to apparatus for controlling the flow of combustion products. While the invention has particular application to controlling the flow of combustion products from stoves which burn wood it will be understood that it also has application to other apparatus which burns other fuels.

The prior art apparatus for controlling the flow of combustion products from a combustion chamber has not resulted in optimum safety and efficiency of operation. The prior art apparatus includes the well known damper which is, of course, merely a disc shaped member which is mounted for rotation on an elongated member which extends through the sides of the flue. The damper has the function of varying the rate at which the combustion products are allowed to escape from a combustion chamber and hence also to control the amount of air which can be drawn into a combustion chamber. Such prior art apparatus has not been wholly satisfactory because the apparatus has been particularly vulnerable to the accumulation of flamable matter such as creosote on the interior surface of the flue. It is known that the accumulation of combustible matter on the interior of the flue is considerably reduced if the temperature of the flue is maintained at an elevated temperature. At least some people believe that a temperature of 400 degrees F. is necessary to avoid the accumulation of undesirable combustible products such as creosote and the like. The applicant has found that a primary reason that flue ducts are not raised to a sufficiently high temperature (to avoid the accumulation of creosote and other combustible materials in the flue) is that the velocity of the gases is not sufficient.

It is a primary object of the invention to provide combustion gas control apparatus which will have flow characteristics which will tend to avoid the accumulation of combustible combustion products in the flue.

It is another object of the invention to provide apparatus which will maintain a relatively high temperature in the exhaust gas duct work, even during periods of low flow of combustion gases from a fire disposed in a combustion chamber.

It is another object of the invention to provide apparatus which will be simple to install in existing flue structures.

It is yet another object of the invention to provide apparatus which will be inexpensive to manufacture.

SUMMARY OF THE INVENTION

The foregoing objects and other objects and advantages which shall become apparent from the detailed description of the preferred embodiment are attained in an apparatus for cooperation with an associated flue, having a first axis extending away from a point proximate to an associated combustion chamber. The apparatus includes a funnel shaped member having first and second ends. The second end may be larger than the first end. A damper is disposed in the associated flue having a generally central bore. Means are provided for mounting the damper in the associated flue for rotation about a second axis which is generally perpendicular to the first axis, and means are provided for mounting the funnel shaped member with the first end higher than the second end and with said second end extending into the damper.

In one form of the invention the means for mounting the damper may comprise at least one rod shaped member extending through at least one wall of the associated flue. The means for mounting the funnel shaped member may comprise a plurality of elongated members extending radially from the funnel shaped member to the associated flue. The apparatus may further include first and second generally planar members carried in the second end of the funnel shaped member. The generally planar members may be mounted for fluid sealing engagement with the interior of the second end of the funnel shaped member.

The first and second generally planar members may be disposed with a slot shaped space intermediate the members. The apparatus may further include a duct extending from and in fluid communication with the first end of the funnel shaped member. The duct extends substantially the entire axial extent of the associated flue above the funnel shaped member. The first and second generally planar members may be semicircular.

In one form the apparatus may cooperate with a flue, having a first axis extending away from a point proximate to an associated combustion chamber. A funnel shaped member has first and second ends. The second end may be larger than the first end. A damper may be disposed in the associated flue having a generally central bore. The means for mounting the damper in the associated flue may allow rotation of the damper about a second axis which is generally perpendicular to the first axis. The means for mounting the funnel shaped member may carry the funnel shaped member with the first end higher than the second end and with the second end extending into the damper. The means for mounting the damper may comprise at least one rod shaped member extending through at least one wall of the flue. The means for mounting the funnel shaped member may comprise a plurality of elongated members extending radially from the funnel shaped member to the flue.

The apparatus may further include first and second generally planar members carried in the second end of the funnel shaped member. The generally planar members may be mounted for fluid sealing engagement with the interior of the second end of the funnel shaped member. The first and second generally planar members may be disposed with a slot shaped space intermediate the members. A duct extends from and in fluid communication with the first end of the funnel shaped member. The duct extends substantially the entire axial extent of the flue above the funnel shaped member. The first and second generally planar members may be semicircular.

In another embodiment of the invention an inner flue may extend along substantially the entire axial extent of the associated flue. The inner flue may define first and second parallel paths which are respectively inside of and outside of the inner flue and means for modulating the flow through one of the flow paths. This embodiment may further include means for mounting the inner flue in generally coaxial relationship with the associated flue. The means for modulating may comprise a pair of generally planar members. The generally planar members may each be pivotally mounted. The inner flue may have a generally rectangular cross section.

DESCRIPTION OF THE PREFERRED EMBODIMENT

Figure 1:
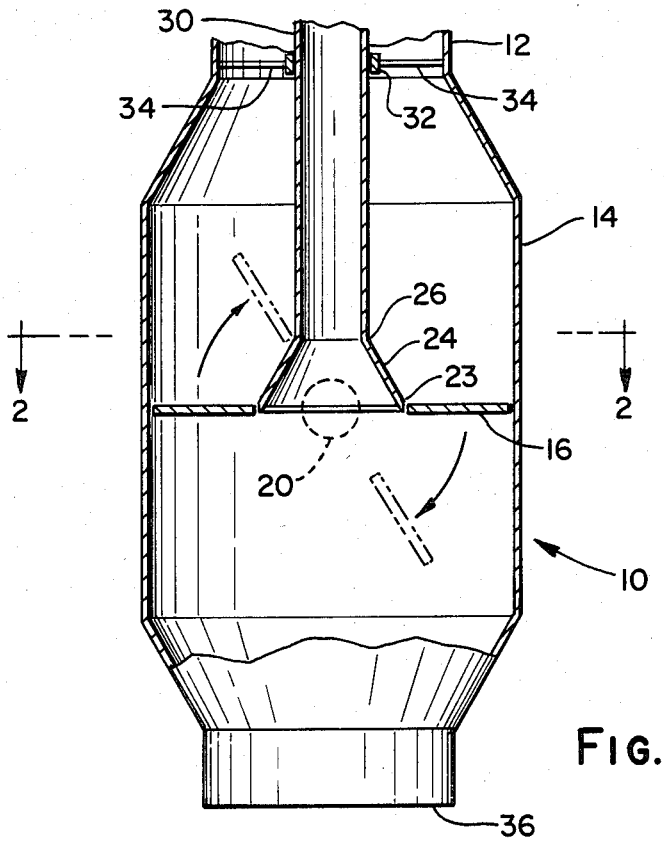
FIG. 1 is a partially schematic elevational view of apparatus in accordance with a first form of the invention.
Figure 2:
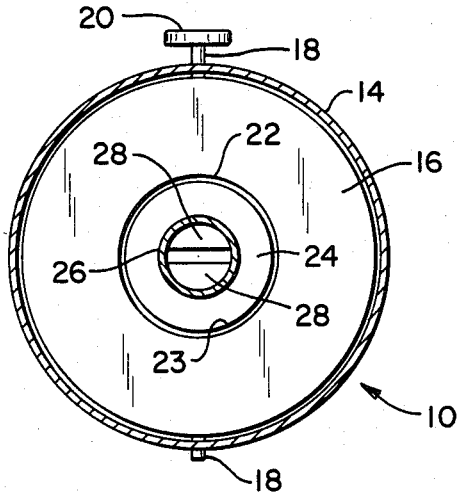
FIG. 2 is a sectional view along the line 2—2 of FIG. 1.
Figure 3:
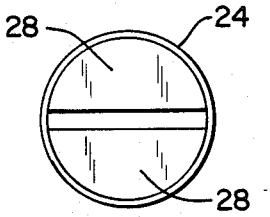
FIG. 3 is a bottom view of a portion of the apparatus of FIG. 1.

Referring now to FIGS. 1, 2 and 3 there is shown a combustion gas control apparatus 10 which includes a first axial section 12 and a second axial section 14. The second axial section 14 has a cylindrical cross section which is larger than the cross section of the first axial section 12. In one embodiment of the invention the second axial section 14 has a diameter of 10 inches and the first axial section 12 has diameter of approximately 8 inches. A damper 16 is mounted for rotation on pins 18, 18 which extend through the wall of the second axial section 14 of the flue. A handle 20 is provided for manually rotating the damper 16. The center of the damper 16, in one form of the invention, is provided with a bore 22, which in one form of the invention, will have a diameter of four inches. In one form of the invention the bore 22 may have a peripherally disposed seal 24 which may be manufactured of asbestos or other material which will provide fluid sealing and which will not be vulnerable to the temperatures which may be encountered within the flue.

Disposed in substantially fluid sealing engagement with the seal 24 is the lower or second axial extremity 23 of the funnel shaped member 24. A first axial extremity 26 of the funnel shaped member 24 has a diameter which is smaller than the second axial extremity 23. In the illustrated embodiments the funnel shaped member 24 is rotationally symetrical. In other embodiments the funnel shaped member 24 may have one side which is generally vertical to improve clearance with respect to the bore 22 of the damper 16.

Referring now particularly to FIG. 3 which is a bottom view of only the funnel shaped member 24. A pair of semicircular generally planar members 28 are fixed in fluid tight relationship about the outer arcuate extent thereof to the second axial extremity 23 of the funnel shaped member 24.

As best seen in FIG. 1 the funnel shaped member 24 is fixed at the first axial extremity 26 to an elongated duct 30 which is disposed in generally coaxial relationship with the first axial extremity 12 of the flue. A ring 32 may be disposed about the elongated duct 30 and may cooperate with elongated members 34, 34 which extend to a portion of the flue, such as the first axial extremity 12.

In operation the damper 16 may be rotated to the position shown in FIG. 2 wherein substantially all the combustion gases being removed from the combustion chamber will be directed through the second axial extremity 23 of the funnel shaped member 24 and out through the duct 30. The relatively rapid flow of a small amount of gas through the duct 30 and also through the funnel shaped member 24 will tend to raise the funnel shaped member 24 and duct 30 to a higher air temperature than would be attained in the flue axial sections 12, 14. This follows because the heating effect of the combustion gases (not shown) will be more attenuated in the much larger flue duct. In addition the larger duct will represent a much larger heat sink than the smaller duct.

The lower axial extremity 36 of the gas control apparatus 10 is, of course, in fluid communication with the associated combustion chamber. During periods when the combustion chamber is being charged with an additional quantity of wood the damper 16 will be rotated from the position shown in FIG. 1 to a position wherein the flow is allowed past the damper 16 and through the annular opening intermediate the axial sections 12 and 14 of the flue on the one hand, and funnel shaped member 24 and the duct 30 on the other hand. It will thus be seen that substantial quantities of combustion products will be carried away and the danger of passing smoke into the room in which the flue is located is minimized. It will be further understood that the asbestos seal 24 allows sufficient deflection to maintain the fluid seal around the lower or second axial extremity 23 and also that the bore does not represent a substantial physical constraint on the movement of the damper 16.

In some forms of the invention the generally planar members 28, 28 may be rectangular or square or some other geometric form or may be omitted entirely from the apparatus. Ordinarily in those embodiments which include these members a small gap will be provided as generally indicated in FIG. 3. Ordinarily the axial portion of the flue immediately surrounding the damper 16 will have a cross section which is larger than portions of the flue more remote from the associated combustion chamber. This is ordinarily preferable since it will result in minimum cost for optimum flow characteristics. It will be understood, however, that the diameter of the flue may be uniform without departing from the spirit of the invention.

Figure 4:
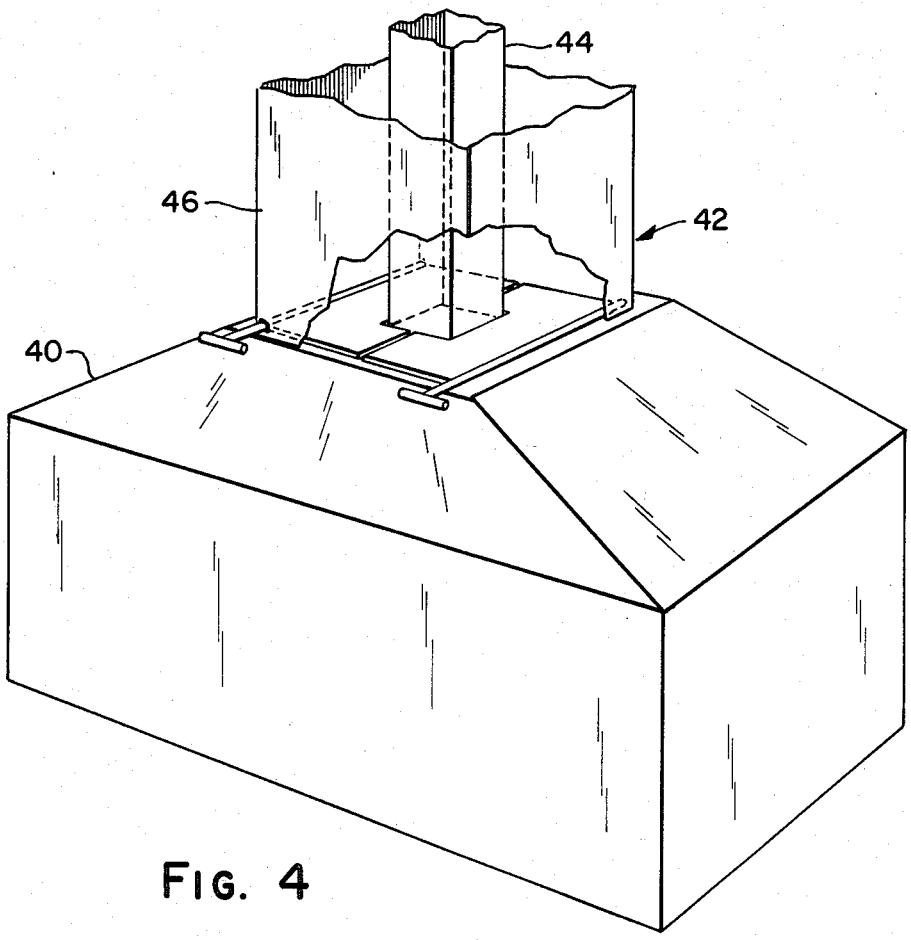
FIG. 4 is a perspective view of a second embodiment of the invention shown in cooperating relationship with an associated fireplace.
Figure 5:
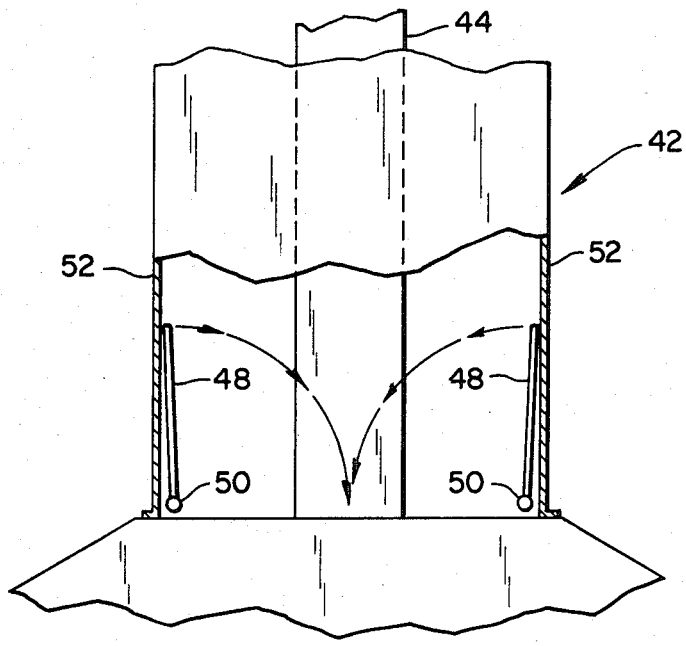
FIG. 5 is a partially schematic sectional view taken through a vertical plane of the second embodiment of the invention.
Figure 6:
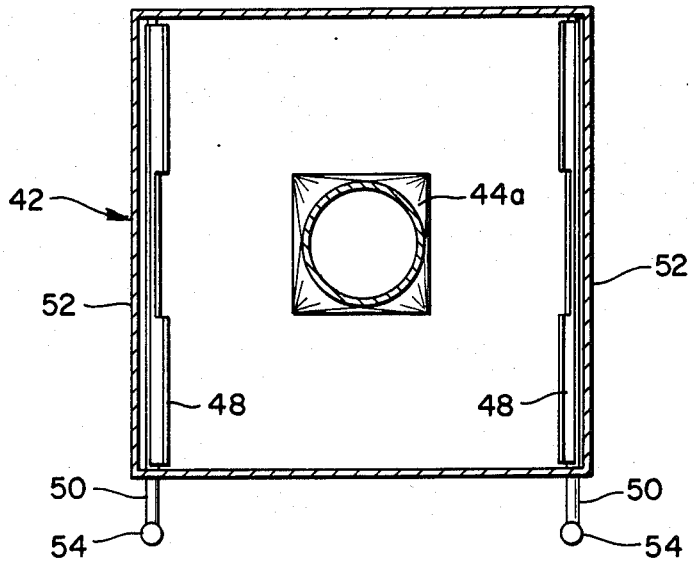
FIGS. 6 and 7 are top views of apparatus which is similar to the second embodiment of the invention FIGS. 4 and 5.

Referring now to FIGS. 4, 5, and 6 there is shown a second embodiment of the apparatus in accordance with the invention in which a fireplace housing 40 is provided with a flue and damper assembly 42 which includes an inner flue 44 which extends up the primary flue (not shown) to the upper axial extremity thereof. The assembly 42 includes a housing 46 through which the inner flue 44 extends. The housing 46 is disposed in fluid communication with the primary flue (not shown). Two dampers 48 are a part of the assembly 42 and are carried on generally parallel shafts 50, 50 which extend proximate to opposed sides 52, 52. The mounting between the assembly 42 and the shafts 50, 50 allows rotational movement of the shafts 50, 50. Handles 54, 54 are respectively attached to the shafts 50, 50 and permit the manual rotation of the dampers 48, 48. In the illustrated embodiment the dampers 48 each are generally rectangular with a rectangular opening therein. The rectangular opening of one damper 48 and the other damper 48 are disposed in aligned relationship so that, as best seen in FIG. 7, a generally square opening is defined at the interface between the dampers 48, 48 and which has a geometric center thereof disposed on the axis of the inner flue 44.

Figure 7:
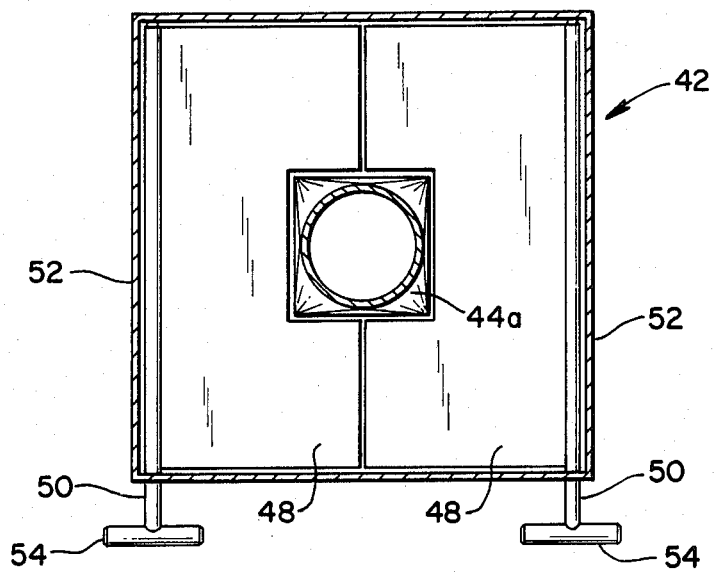

In this embodiment of the invention the inner flue 44 may have either a generally square cross section throughout the axial extent thereof, as best seen in FIG. 4, or may have a generally square cross section which tapers into a generally cylindrical inner flue member 44*a*, as best seen in FIGS. 6 and 7. The inner flue 44 in the embodiment illustrated in FIGS. 4–7 will be open at all times to the upper atmosphere. The control of the flow of exhaust gases from a fire within the fireplace assembly 40 or other stove (not shown) will be by means of the handles 54 which will rotate the shafts 50, 50 to position the dampers 48, 48 in the position illustrated in FIG. 7. For example, with the dampers 48, 48 fully closed all of the exhaust gases will be directed out of the inner flue 44*a*.

In all embodiments of the invention the damper 16 will be divided in two halves and will have a "central bore" when the halves are coplanar. The "central bore" will have a diameter as large as or larger than the inner flue diameter. The size of the inner flue will be selected based on the capacity of the fireplace or stove with which it is associated.

It will be seen that the problem of very low flow of combustion gases in a relatively large flue duct has been eliminated by the structure described herein. More specifically the problem of a conventional damper being barely open during long term operation of a wood stove with the associated build up of creosote and the like is eliminated. It will be further seen that the apparatus in accordance with the invention is simple to install in existing flues. In other forms of the invention an entire assembly including the outer flue may be installed particularly in new construction.

Having thus described my invention I claim:

1. Apparatus for cooperation with an associated flue, having a first axis extending away from a point proximate to an associated combustion chamber, which comprises:

a funnel shaped member having first and second ends, said second end being larger than said first end;

a damper having a generally central bore disposed in the associated flue;

means for mounting said damper in said associated flue for rotation about a second axis which is generally perpendicular to said first axis;

means for mounting said funnel shaped member with said first end higher than said second end and with said second end extending into said damper, said means for mounting said damper comprises at least one rod shaped member extending through at least one wall of the associated flue and said means for mounting said funnel shaped member comprising a plurality of elongated members extending radially from said funnel shaped member to the associated flue; and said apparatus further includes first and second generally planar members carried in said second end of said funnel shaped member, said generally planar members being mounted for fluid sealing engagement with the interior of the said second end of said funnel shaped member.

2. The apparatus as described in claim 1, wherein:

said first and second generally planar members are disposed with a slot shaped space intermediate said members.

3. The apparatus as described in claim 2, further including:

a duct extending from and in fluid communication with said first end of said funnel shaped member, said duct extending substantially the entire axial extent of the associated flue above said funnel shaped member.

4. The apparatus as described in claim 3, wherein:

said first and second generally planar members are semicircular.

5. The apparatus as described in claim 4, wherein:

the associated flue has a cross section at the axial section proximate to said damper which is greater than at least some axial sections more remote from the associated combustion chamber.

6. Apparatus for controlling the flow of combustion gases which comprises:

a flue, having a first axis extending away from a point proximate to an associated combustion chamber, which comprises:

a funnel shaped member having first and second ends, said second end being larger than said first end;

a damper disposed in the associated flue having a generally central bore;

means for mounting said damper in said associated flue for rotation about a second axis which is generally perpendicular to said first axis;

means for mounting said funnel shaped member with said first end higher than said second end and with said second end extending into said damper, said means for mounting said damper comprises at least one rod shaped member extending through at least one wall of said flue, said means for mounting said funnel shaped member comprises a plurality of elongated members extending radially from said funnel shaped member to said flue; and said apparatus further includes first and second generally planar members carried in said second end of said funnel shaped member, said generally planar members being mounted for fluid sealing engagement with the interior of the said second end of said funnel shaped member.

7. The apparatus as described in claim 6, wherein:

said first and second generally planar members are disposed with a slot shaped space intermediate said members.

8. The apparatus as described in claim 7, further including:

a duct extending from and in fluid communication with said first end of said funnel shaped member, said duct extending substantially the entire axial extent of said flue above said funnel shaped member.

9. The apparatus as described in claim 8, wherein:

said first and second generally planar members are semicircular.

10. The apparatus as described in claim 9, wherein:

said flue has a cross sectional area at the axial portion thereof proximate to said damper which is greater than at least some other axial portion thereof which are more remote from the associated combustion chamber.

* * * * *